US011753910B2

(12) United States Patent
Frosell et al.

(10) Patent No.: US 11,753,910 B2
(45) Date of Patent: Sep. 12, 2023

(54) VARIABLE FLOW RESISTANCE SYSTEM FOR USE WITH A SUBTERRANEAN WELL

(71) Applicant: Halliburton Energy Services, Inc., Houston, TX (US)

(72) Inventors: Thomas Jules Frosell, Irving, TX (US); Michael Linley Fripp, Carrollton, TX (US); Zahed Kabir, Garland, TX (US); Zachary Ryan Murphree, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/077,594

(22) PCT Filed: Nov. 18, 2016

(86) PCT No.: PCT/US2016/062702
§ 371 (c)(1),
(2) Date: Aug. 13, 2018

(87) PCT Pub. No.: WO2018/093377
PCT Pub. Date: May 24, 2018

(65) Prior Publication Data
US 2019/0055814 A1 Feb. 21, 2019

(51) Int. Cl.
*E21B 43/12* (2006.01)
*E21B 34/08* (2006.01)
(Continued)

(52) U.S. Cl.
CPC ..... *E21B 43/12* (2013.01); *E21B 34/066* (2013.01); *E21B 34/08* (2013.01); *E21B 34/16* (2013.01);
(Continued)

(58) Field of Classification Search
CPC ..... E21B 34/08; E21B 43/12; E21B 43/14; E21B 34/085
See application file for complete search history.

(56) References Cited

U.S. PATENT DOCUMENTS 5,375,098 A 12/1994 Malone
6,283,207 B1 * 9/2001 Lemetayer ..... E21B 43/12 166/250.15
(Continued)

FOREIGN PATENT DOCUMENTS

CN 201448100 U1 5/2010
CN 204436361 U1 7/2015
(Continued)

OTHER PUBLICATIONS

International Search Report and the Written Opinion for International Application No. PCT/US2016/062702 dated Aug. 10, 2 017, 14 pages.

*Primary Examiner* — Blake Michener
(74) *Attorney, Agent, or Firm* — K&L Gates LLP

(57) ABSTRACT

A variable flow resistance system for use with a subterranean well includes a first flow path configured to receive a fluid, a sensor configured to measure a property of the fluid received into the first flow path, and an actuator configured to control an inflow rate of the fluid received into the first flow path based upon the property of the fluid measured by the sensor.

12 Claims, 4 Drawing Sheets

(51) Int. Cl.

| | |
|---|---|
| ***E21B 34/16*** | (2006.01) |
| ***E21B 47/06*** | (2012.01) |
| ***E21B 43/08*** | (2006.01) |
| ***E21B 34/06*** | (2006.01) |
| ***E21B 41/00*** | (2006.01) |
| ***E21B 49/08*** | (2006.01) |
| *E21B 47/18* | (2012.01) |

(52) U.S. Cl.
CPC ..... *E21B 41/0085* (2013.01); *E21B 43/08* (2013.01); *E21B 47/06* (2013.01); *E21B 49/08* (2013.01); *E21B 47/18* (2013.01)

(56) References Cited

U.S. PATENT DOCUMENTS

| | | | | |
|---|---|---|---|---|
| 6,371,210 | B1 | 4/2002 | Bode | |
| 6,505,682 | B2 * | 1/2003 | Brockman | E21B 17/003 166/250.15 |
| 7,246,660 | B2 | 7/2007 | Fripp | |
| 8,033,328 | B2 | 10/2011 | Hall et al. | |
| 8,573,311 | B2 | 11/2013 | Zhao | |
| 8,678,035 | B2 * | 3/2014 | Fripp | E21B 43/12 137/810 |
| 8,701,771 | B2 | 4/2014 | Dykstra et al. | |
| 8,752,629 | B2 | 6/2014 | Moen | |
| 9,879,506 | B2 | 1/2018 | Frosell et al. | |
| 10,060,221 | B1 * | 8/2018 | Rong | E21B 43/12 |
| 10,101,715 | B2 * | 10/2018 | Lopez | E21B 43/12 |
| 10,626,702 | B2 * | 4/2020 | Ornelaz | E21B 34/066 |
| 2002/0109080 | A1 | 8/2002 | Tubel et al. | |
| 2002/0174981 | A1 * | 11/2002 | Den Boer | E21B 34/066 166/66.5 |
| 2003/0016164 | A1 | 1/2003 | Finke | |
| 2004/0256113 | A1 * | 12/2004 | LoGiudice | E21B 34/066 166/381 |
| 2005/0179263 | A1 | 8/2005 | Johansen et al. | |
| 2008/0007423 | A1 | 1/2008 | Krueger | |
| 2009/0101329 | A1 | 4/2009 | Clem | |
| 2009/0114396 | A1 | 5/2009 | Kusko et al. | |
| 2009/0145609 | A1 * | 6/2009 | Holmes | E21B 43/12 166/332.1 |
| 2011/0060472 | A1 * | 3/2011 | Ocondi | E21B 47/06 700/282 |
| 2011/0180267 | A1 | 7/2011 | Wildman | |
| 2012/0067591 | A1 | 3/2012 | Couturier et al. | |
| 2012/0205122 | A1 * | 8/2012 | Peter | E21B 34/085 166/321 |
| 2012/0255739 | A1 * | 10/2012 | Fripp | E21B 34/08 166/373 |
| 2012/0298370 | A1 | 11/2012 | Xu et al. | |
| 2013/0008648 | A1 | 1/2013 | Lovorn | |
| 2013/0048299 | A1 * | 2/2013 | Fripp | E21B 34/08 166/373 |
| 2013/0222148 | A1 | 8/2013 | Gano et al. | |
| 2013/0292110 | A1 | 11/2013 | Fraser | |
| 2014/0216733 | A1 * | 8/2014 | Mathiesen | E21B 43/32 166/252.5 |
| 2015/0008037 | A1 | 1/2015 | Mullins et al. | |
| 2015/0021015 | A1 | 1/2015 | Xiao | |
| 2015/0040990 | A1 * | 2/2015 | Mathiesen | F16K 31/1221 137/12 |
| 2015/0275622 | A1 * | 10/2015 | Lopez | E21B 43/08 166/53 |
| 2015/0337652 | A1 | 11/2015 | Rodney | |
| 2016/0258283 | A1 | 9/2016 | Bittar et al. | |
| 2016/0305216 | A1 * | 10/2016 | Fripp | E21B 34/08 |
| 2017/0009574 | A1 | 1/2017 | Murphree et al. | |
| 2017/0159405 | A1 * | 6/2017 | Hazel | E21B 34/08 |
| 2018/0283134 | A1 * | 10/2018 | Ornelaz | E21B 43/08 |

FOREIGN PATENT DOCUMENTS

| | | | |
|---|---|---|---|
| CN | 105089572 | B1 | 3/2018 |
| EP | 2708858 | A1 | 3/2014 |
| EP | 2920409 | B1 | 1/2017 |
| EP | 2697473 | B1 | 2/2018 |
| GB | 2522272 | A | 7/2015 |
| WO | 0131167 | A8 | 10/2001 |
| WO | 2002006593 | A1 | 1/2002 |
| WO | 2006085870 | A1 | 8/2006 |
| WO | 2009017900 | A2 | 2/2009 |
| WO | 2009052114 | A2 | 4/2009 |
| WO | 2009055676 | A1 | 4/2009 |
| WO | 2012100259 | A2 | 7/2012 |
| WO | 2015167467 | A1 | 11/2015 |
| WO | 2016141456 | A1 | 9/2016 |

* cited by examiner

VARIABLE FLOW RESISTANCE SYSTEM FOR USE WITH A SUBTERRANEAN WELL

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

This disclosure relates generally to equipment utilized and operations performed in conjunction with a subterranean well and, in an example described below, more particularly provides a selectively variable flow restrictor.

In a hydrocarbon production well, it is many times beneficial to be able to regulate flow of fluids from an earth formation into a wellbore, from the wellbore into the formation, and within the wellbore. A variety of purposes may be served by such regulation, including prevention of water or gas coning, minimizing sand production, minimizing water and/or gas production, maximizing oil production, balancing production among zones, transmitting signals, etc.

Therefore, it will be appreciated that advancements in the art of variably restricting fluid flow in a well would be desirable in the circumstances mentioned above, and such advancements would also be beneficial in a wide variety of other circumstances.

BRIEF DESCRIPTION OF THE DRAWINGS

Illustrative embodiments of the present disclosure are described in detail below with reference to the attached drawing figures, which are incorporated by reference herein and wherein.

Figure 1:
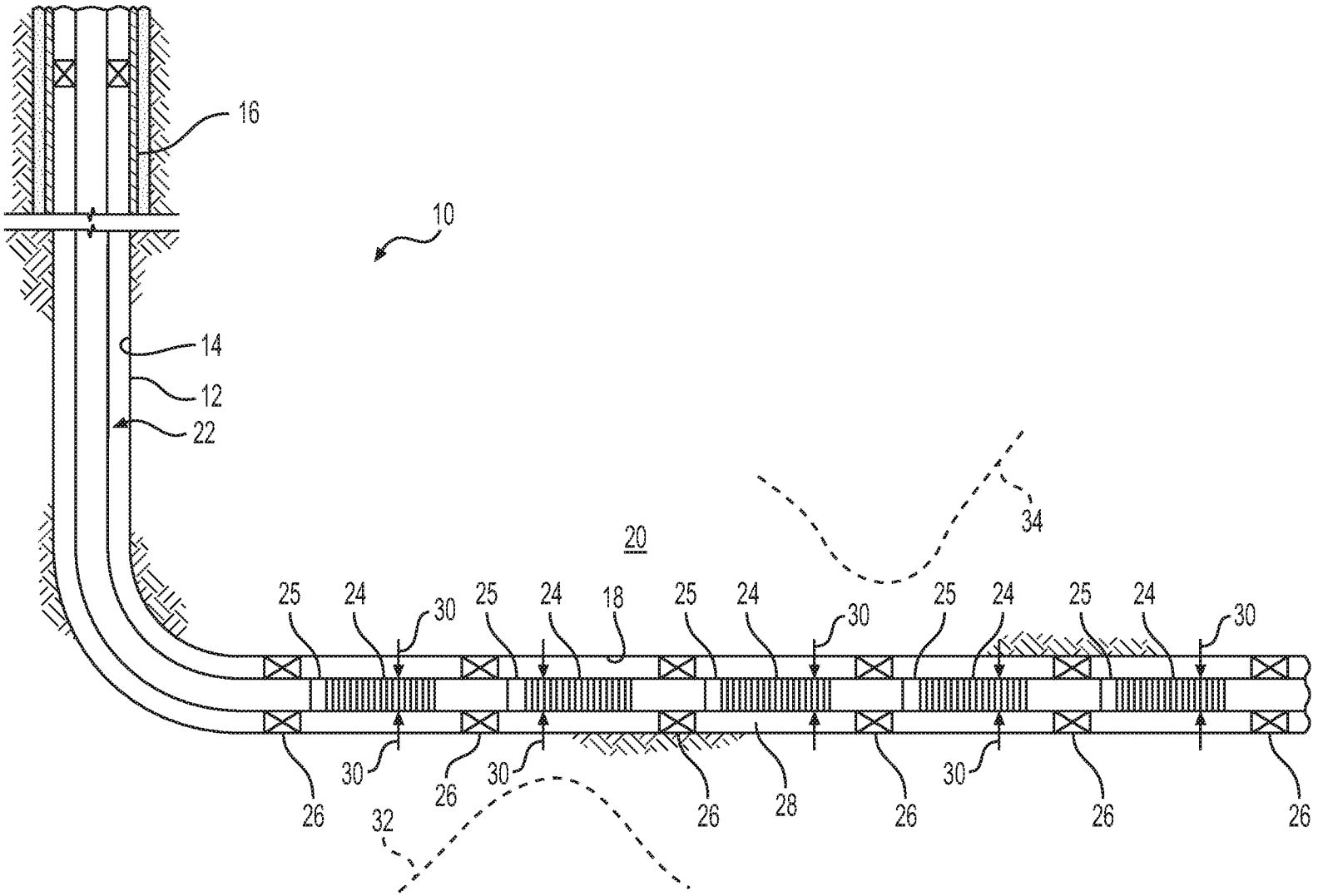
FIG. 1 shows schematic view of a well system including a variable flow resistance system in accordance with one or more embodiments of the present disclosure.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

The following discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Turning now to the present figures, FIG. 1 shows a well system 10 that can embody principles of the present disclosure. As depicted in FIG. 1, a wellbore 12 has a generally vertical uncased section 14 extending downwardly from casing 16, as well as a generally horizontal uncased section 18 extending through an earth formation 20.

A tubular string 22 (such as a production tubing string) is installed in the wellbore 12. Interconnected in the tubular string 22 are multiple well screens 24, variable flow resistance systems 25, and packers 26. The packers 26 seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26.

Positioned between each adjacent pair of the packers 26, a well screen 24 and a variable flow resistance system 25 are interconnected in the tubular string 22. The well screen 24 filters the fluids 30 flowing into the tubular string 22 from the annulus 28. The variable flow resistance system 25 variably restricts flow of the fluids 30 into the tubular string 22, based on certain characteristics of the fluids.

At this point, it should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein.

For example, it is not necessary in keeping with the principles of this disclosure for the wellbore 12 to include a generally vertical wellbore section 14 or a generally horizontal wellbore section 18, as a wellbore section may be oriented in any direction, and may be cased or uncased, without departing from the scope of the present disclosure. It is not necessary for fluids 30 to be only produced from the formation 20 since, in other examples, fluids could be injected into a formation, fluids could be both injected into and produced from a formation, etc. Further, it is not necessary for one each of the well screen 24 and variable flow resistance system 25 to be positioned between each adjacent pair of the packers 26. It is not necessary for a single variable flow resistance system 25 to be used in conjunction with a single well screen 24. Any number, arrangement and/or combination of these components may be used.

It is not necessary for any variable flow resistance system 25 to be used with a well screen 24. For example, in injection operations, the injected fluid could be flowed through a variable flow resistance system 25, without also flowing through a well screen 24.

It is not necessary for the well screens 24, variable flow resistance systems 25, packers 26 or any other components of the tubular string 22 to be positioned in uncased sections 14, 18 of the wellbore 12. Any section of the wellbore 12 may be cased or uncased, and any portion of the tubular string 22 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

It will be appreciated by those skilled in the art that it would be beneficial to be able to regulate flow of the fluids 30 into the tubular string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, etc.

Examples of the variable flow resistance systems 25 described more fully below can provide these benefits by increasing resistance to flow if a fluid velocity increases beyond a selected level (e.g., to thereby balance flow among zones, prevent water or gas coning, etc.), or increasing resistance to flow if a fluid viscosity decreases below a selected level (e.g., to thereby restrict flow of an undesired fluid, such as water or gas, in an oil producing well).

Whether a fluid is a desired or an undesired fluid depends on the purpose of the production or injection operation being conducted. For example, if it is desired to produce oil from a well, but not to produce water or gas, then oil is a desired fluid and water and gas are undesired fluids.

Note that, at downhole temperatures and pressures, hydrocarbon gas can actually be completely or partially in liquid phase. Thus, it should be understood that when the term "gas" is used herein, supercritical, liquid and/or gaseous phases are included within the scope of that term.

Figure 2:
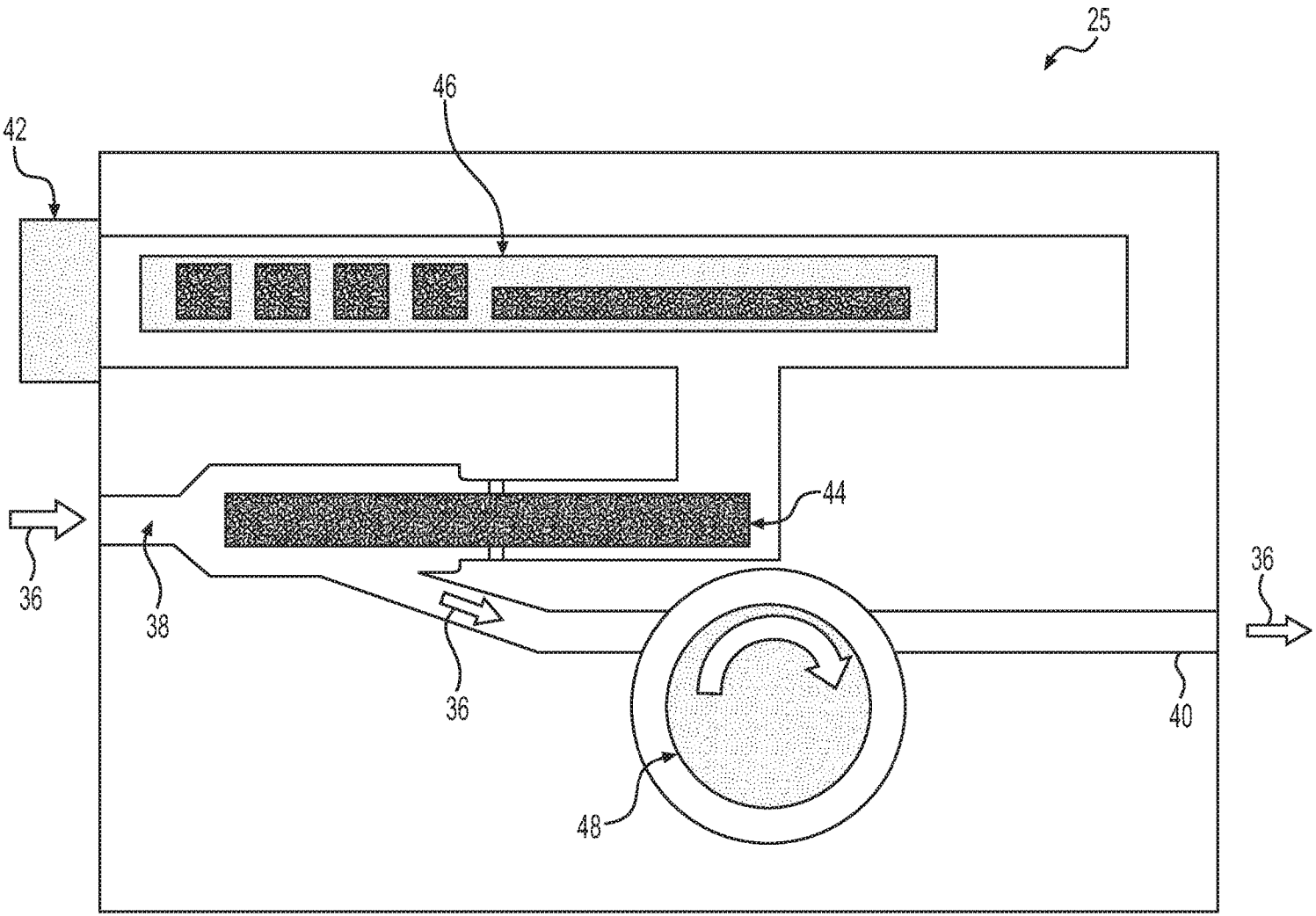
FIG. 2 shows a schematic view of a variable flow resistance system in accordance with one or more embodiments of the present disclosure.

Referring additionally now to FIG. 2, a schematic view of a variable flow resistance system 25 in accordance with one or more embodiments of the present disclosure is shown. In this example, a fluid 36 (which can include one or more fluids, such as oil and water, liquid water and steam, oil and gas, gas and water, oil, water and gas, etc.) may be filtered by a well screen (24 in FIG. 1), and may then flow into a first flow path 38 (e.g., an inlet flow path) of the variable flow resistance system 25. A fluid can include one or more undesired or desired fluids. Both steam and water can be combined in a fluid. As another example, oil, water and/or gas can be combined in a fluid. Flow of the fluid 36 through the variable flow resistance system 25 is resisted based on one or more characteristics (e.g., viscosity, velocity, etc.) of the fluid. The fluid 36 may then be discharged from the variable flow resistance system 25 to an interior of the tubular string 22 via a second flow path 40 (e.g., an outlet flow path). As used herein, the first flow path 38 and the second flow path 40 may be generally described and function as an inlet flow path and an outlet flow path, respectively. However, the present disclosure is not so limited, as the flow of the fluid 36 may be reversed in the variable flow resistance system 25 such that the first flow path 38 and the second flow path 40 may be generally described and function as an outlet flow path and an inlet flow path, respectively.

In other examples, the well screen 24 may not be used in conjunction with the variable flow resistance system 25 (e.g., in injection operations), the fluid 36 could flow in an opposite direction through the various elements of the well system 10 (e.g., in injection operations), a single variable flow resistance system could be used in conjunction with multiple well screens, multiple variable flow resistance systems could be used with one or more well screens, the fluid could be received from or discharged into regions of a well other than an annulus or a tubular string, the fluid could flow through the variable flow resistance system prior to flowing through the well screen, any other components could be interconnected upstream or downstream of the well screen and/or variable flow resistance system, etc. Thus, it will be appreciated that the principles of this disclosure are not limited at all to the details of the example depicted in the figures and described herein. Further, additional components (such as shrouds, shunt tubes, lines, instrumentation, sensors, inflow control devices, etc.) may also be used in accordance with the present disclosure, if desired.

The variable flow resistance system 25 is depicted in simplified form in FIG. 2, but in a preferred example, the system can include various passages and devices for performing various functions, as described more fully below. In addition, the system 25 preferably at least partially extends circumferentially about the tubular string 22, or the system may be formed in a wall of a tubular structure interconnected as part of the tubular string.

In other examples, the system 25 may not extend circumferentially about a tubular string or be formed in a wall of a tubular structure. For example, the system 25 could be formed in a flat structure, etc. The system 25 could be in a separate housing that is attached to the tubular string 22, or it could be oriented so that the axis of the second flow path 40 is parallel to the axis of the tubular string. The system 25 could be on a logging string or attached to a device that is not tubular in shape. Any orientation or configuration of the system 25 may be used in keeping with the principles of this disclosure.

Referring still to FIG. 2, the variable flow resistance system 25 includes the first flow path 38 to receive fluid into the system 25 and a second flow path 40 to send fluid out of the system 25. When fluid exits the system 25, the fluid may, for example, then enter into the interior of a tool body that may be used in conjunction with the variable flow resistance system 25. The variable flow resistance system 25 may further include a sensor 42 and an actuator 44. The sensor 42 may be positioned near or adjacent the first flow path 38 to measure a property of the fluid received into the system 25 through the first flow path 38. The actuator 44 may control or adjust an inflow rate of fluid received into the system 25 and the first flow path 38 based upon the property of the fluid measured by the sensor 42. For example, the actuator 44 may be positioned or included within the system 25 to extend into and retract from the fluid flow path extending and formed through the system 25. To increase the inflow rate of the fluid, the actuator 44 may retract to enable more fluid to flow through the fluid flow path of the system 25. To decrease the inflow rate of the fluid, the actuator 44 may extend to restrict the fluid flow through the fluid flow path of the system 25. Further, in one or more embodiments, the actuator 44 may be used to fully stop or inhibit the fluid flow through the fluid flow path of the system 25. For example, if the system 25 is turned or powered off, the actuator 44 may fully extend to prevent fluid flow through the fluid flow path of the system 25.

In one or more embodiments, the sensor 42 may be used to measure a resistivity of the fluid, a flow rate of the fluid, a pressure of the fluid, a pressure differential of the fluid within the system 25, a density of the fluid, a viscosity of the fluid, and/or any other property or characteristic of the fluid known in the art. The sensor 42 may include a resistivity sensor, a conductivity sensor, a capacitive sensor, an inductive sensor, an acoustic sensor, a nuclear sensor, a temperature sensor, a flow sensor, and an acoustic sensor and/or any other type of sensor known in the art. For example, in an embodiment in which the sensor 42 includes an acoustic sensor, the acoustic sensor may be used to listen, detect, and/or measure turbulence in the fluid flow to measure flow rate of the fluid, and/or determine if sand is being produced with the fluid.

Further, the actuator 44 may include a mechanical actuator (e.g., a screw assembly), an electrical actuator (e.g., piezoelectric actuator, electric motor), a hydraulic actuator (e.g., hydraulic cylinder and pump, hydraulic pump), a pneumatic actuator, and/or any other type of actuator known in the art. For example, the actuator 44 may include a linear or axially driven actuator, in which the actuator 44 interacts with an orifice included in the first flow path 38 to control the inflow rate of the fluid.

Furthermore, though only one sensor and one actuator are shown in FIG. 2, the present disclosure is not so limited, as more than one sensor and/or more than one actuator may be used in accordance with the present disclosure. In such an embodiment, if using multiple sensors or actuators, the sensors and actuators used may be different from each other and/or may have different thresholds or tolerances than each other. For example, multiple different sensors may be used to measure different properties of the fluid, and multiple different actuators may be used to control the inflow rate of the fluid using different techniques or at different thresholds.

The variable flow resistance system 25 may further include a controller and corresponding electronics 46 to control and manage the operation of the components of the system 25. In one embodiment, the controller may be in communication or coupled between the sensor 42 and the actuator 44 to control the actuator 44 based upon the property of the fluid measured by the sensor 42. The controller may be used to receive the property measured by the sensor 42 and compare the measured property with that of a predetermined value for the measured property. Based upon the comparison of the measured property with that of the predetermined value, the controller may then move the actuator 44 to adjust the inflow rate of fluid received into the first flow path 38 of the system 25.

As an example, in one or more embodiments, the controller may receive the resistivity measured by the sensor 42 and compare the measured resistivity with a predetermined value for the resistivity of the fluid. The measured resistivity may be used to represent or indicate the type of fluid being received into the system, such as if the fluid contains brine, water, oil, and/or gas, and also potential proportions of these components. In one embodiment, based upon the desired fluid to be received into the system, if the measured resistivity of the fluid is above the predetermined value for the resistivity of the fluid, then the controller may be used to move the actuator 44 to increase the inflow rate of the fluid received into the first flow path 38. If the measured resistivity of the fluid is below the predetermined value for the resistivity of the fluid, the controller may be used to move the actuator 44 to decrease the inflow rate of the fluid received into the first flow path 38.

Referring still to FIG. 2, the variable flow resistance system 25 may include a communications unit (e.g., transmitter or receiver) to send and/or receive communications signals. The communications unit, for example, may be included within the electronics 46 and may be used to receive a communications signal when the system 25 is downhole within a well and/or may be used to send a communications signal up hole or between downhole devices. The actuator 44 may control the inflow rate of fluid received into the first flow path 38 based upon the communications signal received by the communications unit. For example, one or more communications signals may be sent from the communications unit to the surface to report properties measured by the system 25 (e.g., telemetry) and/or characteristics of the system 25 (e.g., fluid inflow rate into the system 25). One or more communications may additionally or alternatively be received by the communications unit, such as to facilitate control of one or more components of the system 25.

A communications signal may be received by the communications unit to control the inflow rate of the fluid received into the first flow path 38 of the system 25, such as to increase or decrease the fluid inflow rate into or through the system 25. Communication signals may be used to indicate that the well is in a preliminary phase, intermediate phase, or final phase, in which different control parameters may be used for each of these different phases of the well. Further, communication signals may be used to confirm that the system 25 is working properly and/or confirm downhole conditions of the well. A communication unit may include one or more sensors for telemetry, such as an accelerometer, a gyroscope, and/or a hydrophone. A communication unit may also be capable of use with mud-pulse telemetry, pressure profile telemetry, flow rate telemetry, acoustic pulse telemetry, and/or pseudo-static pressure profile telemetry.

Figure 3:
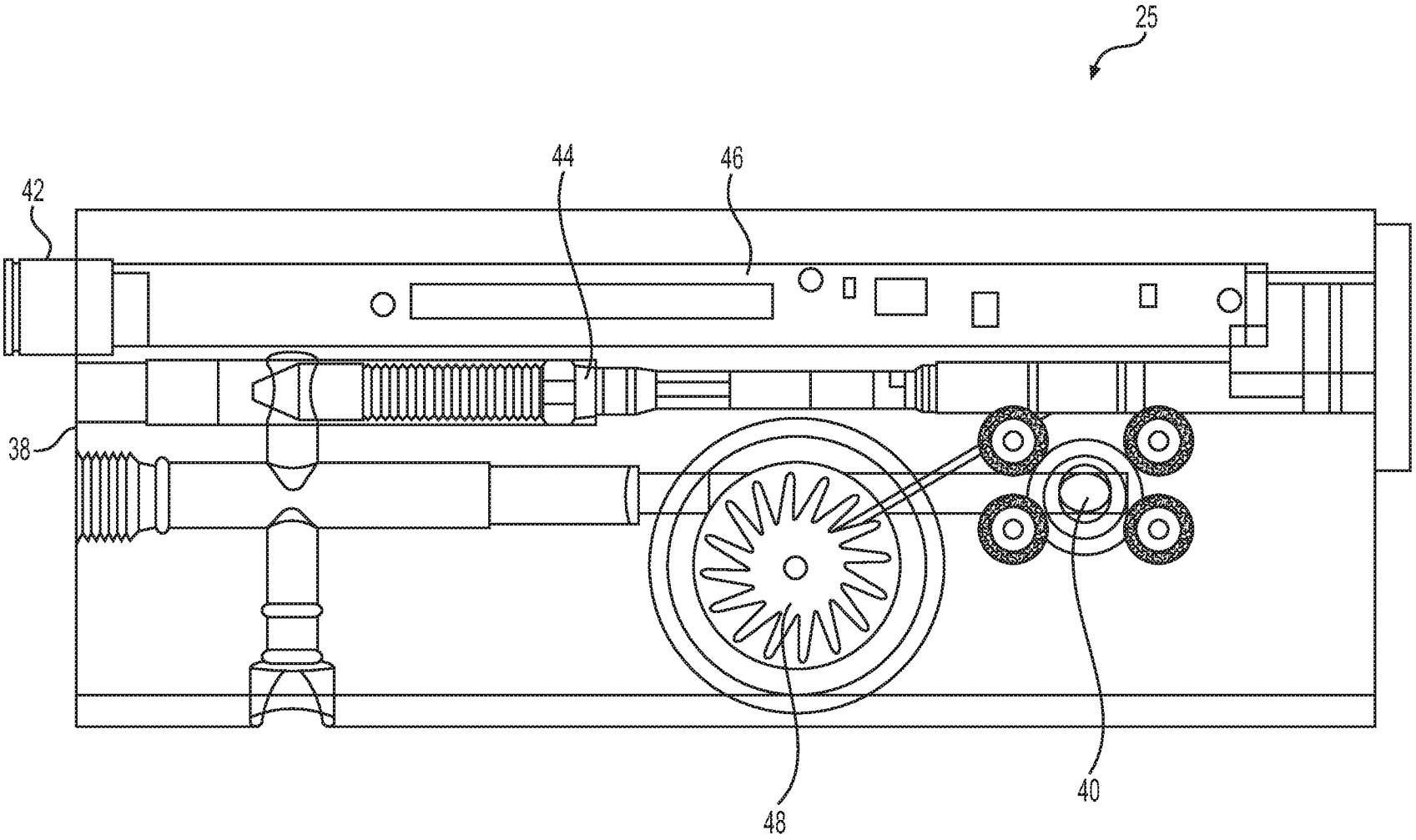
FIG. 3 shows a detailed view of a variable flow resistance system in accordance with one or more embodiments of the present disclosure.

In one or more embodiments, the variable flow resistance system 25 may include a power generator 48 and/or a power storage device. The power generator 48 may be used to generate power for the system 25, and the power storage device may be used to store power for the system 25 and/or store power generated by the power generator 48. For example, FIG. 3 shows a detailed view of a variable flow resistance system 25 in accordance with one or more embodiments of the present disclosure. The variable flow resistance system 25 in FIG. 3 may be an alternative embodiment to the variable flow resistance system 25 in FIG. 2, in which like features have like reference numbers. In FIG. 3, the power generator 48 may include a turbine and may be able to generate power from fluid received into the first flow path 38 and flowing through the system 25. The power generator 48 may additionally or alternatively include other types of power generators, such as a flow induced vibration power generator and/or a piezoelectric generator, to generate power from the fluid received into the system 25 and/or from other energy sources present downhole (e.g., temperature and/or pressure sources).

The power storage device, for example, may be included within the electronics 46 and may be used to store power, such as power generated by the power generator 48. The power storage device may include a capacitor (e.g., super capacitor), battery (e.g., rechargeable battery), and/or any other type of power storage device known in the art. In one or more embodiments, as the sensor(s) and/or actuator(s) of the system 25 may require more power than generated by the power generator 48, the power storage device may be used to store power, and then supplement the power generator 48 when running the sensor(s), actuator(s), and/or other components of the system 25.

Figure 4:
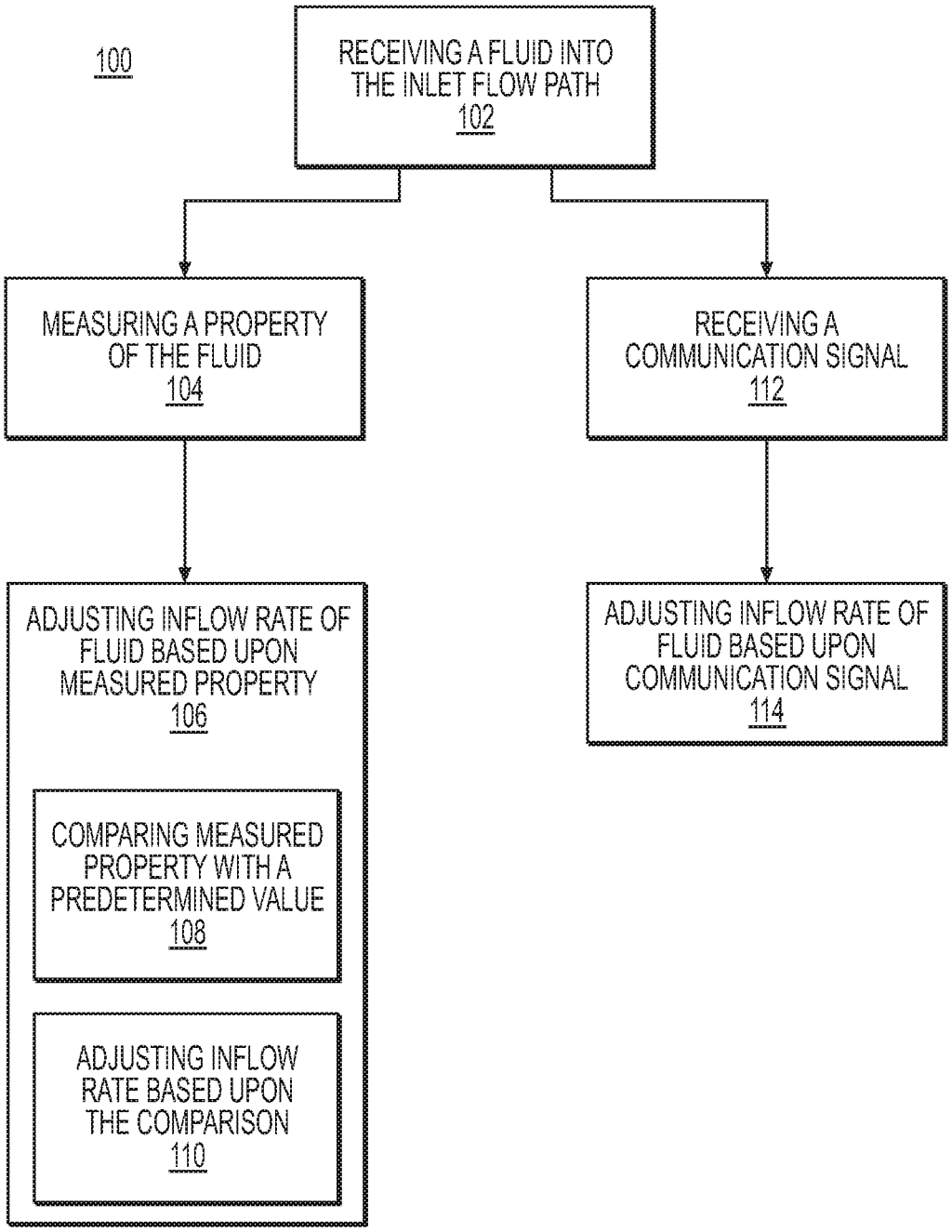
FIG. 4 shows a flowchart of a method of variably controlling flow resistance in a well.

Referring now to FIG. 4, a flowchart of a method 100 of variably controlling flow resistance in a well in accordance with one or more embodiments of the present disclosure is shown. The method 100 includes receiving a fluid into a first flow path 102, such as into the first flow path of a variable flow resistance device, tool, or system. The method 100 then may follow with measuring a property of the fluid received into the first flow path 104, such as with the sensor of the variable flow resistance system, and then adjusting an inflow rate of the fluid received into the first flow path based upon the measured property of the fluid 106, such as with the actuator of the variable flow resistance system. The adjusting the inflow rate of the fluid 106 may include comparing the measured property of the fluid with a predetermined value 108, such as the measured property including a resistivity, flow rate, pressure, density, viscosity, conductivity, capacitance, inductance, radioactivity, temperature, and/or acoustic signature of the fluid. The adjusting the inflow rate of the fluid 106 may then further include adjusting the inflow rate of the fluid received into the first flow path based upon the comparison of the measured property of the fluid with the predetermined value 110. Additionally or alternatively, the method 100 may follow the receiving the fluid into the first flow path 102 with receiving a communication/control signal from a remote location 112. The method 100 may then further include adjusting the inflow rate of the fluid received into the first flow path based upon the received communication/control signal 114.

In addition to the embodiments described above, many examples of specific combinations are within the scope of the disclosure, some of which are detailed below:

Example 1

A variable flow resistance system for use with a subterranean well, the system comprising:
a first flow path configured to receive a fluid;
a sensor configured to measure a property of the fluid received into the first flow path; and
an actuator configured to control an inflow rate of the fluid received into the first flow path based upon the property of the fluid measured by the sensor.

Example 2

The variable flow resistance system of Example 1, wherein the property of the fluid to be measured by the sensor comprises at least one of a resistivity of the fluid, a flow rate of the fluid, a pressure of the fluid, a density of the fluid, and a viscosity of the fluid.

Example 3

The variable flow resistance system of Example 1, wherein the sensor comprises at least one of a resistivity sensor, a conductivity sensor, a capacitive sensor, an inductive sensor, a nuclear sensor, a temperature sensor, a flow sensor, and an acoustic sensor.

Example 4

The variable flow resistance system of Example 1, further comprising a controller configured to control the actuator based upon the property of the fluid measured by the sensor.

Example 5

The variable flow resistance system of Example 1, further comprising a power generator configured to generate power for the variable flow resistance system.

Example 6

The variable flow resistance system of Example 5, wherein the power generator comprises a turbine configured to generate power solely from fluid received into the first flow path.

Example 7

The variable flow resistance system of Example 5, further comprising a power storage device configured to store power generated by the power generator.

Example 8

The variable flow resistance system of Example 1, further comprising a communications unit configured to at least one of receive a communications signal and send a communications signal.

Example 9

The variable flow resistance system of Example 8, wherein the actuator is configured to control the inflow rate of fluid received into the first flow path based upon the communications signal received by the communications unit.

Example 10

The variable flow resistance system of Example 1, further comprising a tool body and a second flow path configured to send the fluid into an interior of the tool body.

Example 11

The variable flow resistance system of Example 1, further comprising a production tubing string, wherein the first flow path comprises a production orifice for the production tubing string.

Example 12

The variable flow resistance system of Example 1, wherein the actuator comprises at least one of a screw assembly, a piezoelectric actuator, a hydraulic cylinder, an electric motor, and a hydraulic pump.

Example 13

A method of variably controlling flow resistance in a well, the method comprising:

receiving a fluid into a first flow path;

measuring a property of the fluid received into the first flow path; and adjusting an inflow rate of the fluid received into the first flow path based upon the measured property of the fluid.

Example 14

The method of Example 13, wherein the adjusting the inflow rate comprises:

comparing the measured property of the fluid with a predetermined value; and adjusting the inflow rate of the fluid received into the first flow path based upon the comparison of the measured property of the fluid with the predetermined value.

Example 15

The method of Example 13, wherein the measuring the property of the fluid comprises measuring at least one of resistivity, flow rate, pressure, density, and viscosity of the fluid.

Example 16

The method of Example 13, wherein the measuring the property of the fluid comprises measuring a resistivity of the fluid, and wherein the adjusting the inflow rate comprises:

comparing the measured resistivity of the fluid with a predetermined value for the resistivity of the fluid;

increasing the inflow rate of the fluid received into the first flow path if the measured resistivity of the fluid is above the predetermined value for the resistivity of the fluid; and decreasing the inflow rate of the fluid received into the first flow path if the measured resistivity of the fluid is below the predetermined value for the resistivity of the fluid.

Example 17

The method of Example 13, further comprising generating power from the fluid received into the first flow path.

Example 18

The method of Example 13, wherein the first flow path comprises a production orifice for a production tubing string.

Example 19

The method of Example 13, further comprising:

receiving a communication signal from a remote location; and adjusting the inflow rate of the fluid received into the first flow path based upon the received communication signal.

Example 20

A method of variably controlling flow resistance in a well, the method comprising:

receiving a fluid into a first flow path;

receiving a communication signal from a remote location; and adjusting an inflow rate of the fluid received into the first flow path based upon the received communication signal.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A variable flow resistance system for use and locatable within a subterranean well, the system comprising:

a first flow path configured to receive a flow of a fluid in a first direction when producing a fluid from the subterranean well;

sensors configured to measure properties of the fluid received into the first flow path, wherein the measured properties comprise a fluid flow rate and a fluid viscosity;

a communications unit configured to receive a first communications signal from the surface indicating one of a plurality of production phases of the well, the plurality of production phases comprising a preliminary phase, an intermediate phase, and a final phase;

an actuator configured to control a flow rate of the fluid received into the first flow path by moving axially in the direction of fluid flow in the first flow path;

a power generator located downstream of the actuator with respect to the first direction and comprising a turbine configured to generate power for the variable flow resistance system;

a power storage device configured to store at least some of the power generated by the power generator; and a controller in communication with the communications unit and the actuator, the controller configured to adjust the actuator based upon a comparison of at least one of the properties of the fluid measured by the sensor and predetermined values of the properties and control parameters associated with the indicated production phase of the well, wherein the controller is further configured to variably adjust the actuator to increase resistance to the flow of the fluid responsive to determining that the measured fluid flow rate increases beyond a first predetermined level or the measured fluid viscosity decreases below a second predetermined level.

2. The variable flow resistance system of claim 1, wherein the measured properties of the fluid further comprise at least one of a resistivity of the fluid a pressure of the fluid, or a density of the fluid.

3. The variable flow resistance system of claim 1, wherein the sensors comprise at least one of a resistivity sensor, a conductivity sensor, a capacitive sensor, an inductive sensor, a nuclear sensor, a temperature sensor, a flow sensor, or an acoustic sensor.

4. The variable flow resistance system of claim 1, wherein the communications unit is further configured to send a communications signal.

5. The variable flow resistance system of claim 1, further comprising a tool body and a second flow path configured to send the fluid into an interior of the tool body.

6. The variable flow resistance system of claim 1, further comprising a production tubing string, wherein the first flow path comprises a production orifice for the production tubing string.

7. The system of claim 1, wherein:

the communications unit is further configured to receive a second communications signal from the surface commanding the controller to adjust a flow rate of the fluid received into the first flow path; and the controller is further configured to control the actuator based upon the second communications signal.

8. A method of variably controlling flow resistance in a well, the method comprising:

receiving a flow of a fluid in a first direction when receiving the fluid from the well into a first flow path of a variable flow resistance system installed in the well;

measuring properties of the fluid received into the first flow path, the measured properties comprising a fluid flow rate and a fluid viscosity;

receiving a communication signal from the surface indicating one of a plurality of production phases of the well, the plurality of production phases comprising a preliminary phase, an intermediate phase, and a final phase;

adjusting a flow rate of the fluid received into the first flow path using a controller of the variable flow resistance system based upon a comparison of at least one of the measured properties of the fluid and a predetermined value of the properties and control parameters associated with the indicated production phase of the well, wherein adjusting the flow rate comprises axially moving an actuator in the direction of fluid flow into the first flow path; and generating power from the fluid received into the first flow path with a power generator located downstream of the actuator with respect to the first direction;

storing at least some of the generated power in a power storage device, wherein adjusting the flow rate further comprises increasing resistance to flow of the fluid responsive to determining that the measured fluid flow rate increases beyond a first predetermined level or the measured fluid viscosity decreases below a second predetermined level.

9. The method of claim 8, wherein the measuring the properties of the fluid further comprises measuring at least one of resistivity, pressure, or density.

10. The method of claim 8, wherein the measuring the properties of the fluid further comprises measuring a resistivity of the fluid, and wherein the adjusting the flow rate comprises:

increasing the flow rate of the fluid received into the first flow path if the measured resistivity of the fluid is above the predetermined value for the resistivity of the fluid; and decreasing the flow rate of the fluid received into the first flow path if the measured resistivity of the fluid is below the predetermined value for the resistivity of the fluid.

11. The method of claim 8, wherein the first flow path comprises a production orifice for a production tubing string.

12. A method of variably controlling flow resistance in a well, the method comprising:

receiving a flow of a fluid in a first direction when producing the fluid from the well into a first flow path of a variable flow resistance system installed in the well;

measuring properties of the fluid received into the first flow path with sensors, wherein the measured properties comprise a fluid flow rate and a fluid viscosity;

receiving a communication signal from the surface indicating one of a plurality of production phases of the well, the plurality of production phases comprising a preliminary phase, an intermediate phase, or a final phase; and adjusting a flow rate of the fluid received into the first flow path using a controller of the variable flow resistance system based upon a comparison of at least one of the properties of the fluid measured by the sensors and predetermined values of the properties and the production phase of the well, wherein adjusting the flow rate comprises axially moving an actuator in the direction of fluid flow into the first flow path;

wherein adjusting the flow rate further comprises increasing resistance to flow responsive to determining that the measured fluid flow rate increases beyond a first predetermined level or the measured fluid viscosity decreases below a second predetermined level.

* * * * *